US007055819B2

(12) United States Patent
Eitel et al.

(10) Patent No.: US 7,055,819 B2
(45) Date of Patent: Jun. 6, 2006

(54) DEVICE AND A METHOD FOR ALIGNING SHEETS

(75) Inventors: Johann Emil Eitel, Thüngen (DE); Manfred Wilhelm Kohrmann, Helmstadt/Holzkirchhausen (DE); Kurt Georg Nagler, Zell/Main (DE); Johannes Georg Schaede, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 334 days.

(21) Appl. No.: 10/433,484

(22) PCT Filed: Nov. 28, 2001

(86) PCT No.: PCT/DE01/04478

§ 371 (c)(1),
(2), (4) Date: Jun. 13, 2003

(87) PCT Pub. No.: WO02/48011

PCT Pub. Date: Jun. 20, 2002

(65) Prior Publication Data

US 2004/0026847 A1 Feb. 12, 2004

(30) Foreign Application Priority Data

Dec. 15, 2000 (DE) ..... 100 62 821

(51) Int. Cl.
*B65H 7/02* (2006.01)

(52) U.S. Cl. ..... 271/227; 271/228

(58) Field of Classification Search ..... 271/227, 271/228, 229, 230, 243, 236
See application file for complete search history.

(56) References Cited

U.S. PATENT DOCUMENTS

| | | | | |
|---|---|---|---|---|
| 3,743,277 | A | 7/1973 | Bolza-Schünemann et al. | |
| 4,588,184 | A | 5/1986 | Jeschke | |
| 5,078,384 | A | 1/1992 | Moore | |
| 5,527,027 | A | 6/1996 | Flade et al. | |
| 5,697,608 | A * | 12/1997 | Castelli et al. | 271/228 |
| 5,697,609 | A | 12/1997 | Williams et al. | |
| 5,724,150 | A | 3/1998 | Schaede et al. | |
| 6,019,365 | A * | 2/2000 | Matsumura | 271/227 |
| 6,135,446 | A | 10/2000 | Thiemann et al. | |
| 6,182,959 | B1 | 2/2001 | Eitel et al. | |
| 6,213,282 | B1 | 4/2001 | Mokler et al. | |
| 6,663,103 | B1 * | 12/2003 | Dobberstein et al. | 271/227 |
| 6,676,123 | B1 * | 1/2004 | Sahlmann | 271/227 |
| 2002/0074718 | A1 * | 6/2002 | Schlageter | 271/227 |

FOREIGN PATENT DOCUMENTS

| | | | |
|---|---|---|---|
| DE | 2 046 602 | | 6/1972 |
| DE | 23 13 150 | C3 | 12/1981 |
| DE | 42 39 732 | A1 | 6/1994 |
| EP | 0 120 348 | A2 | 10/1984 |
| EP | 0 716 287 | A2 | 6/1996 |
| EP | 0 947 455 | A1 | 10/1999 |
| JP | 6-191684 | * | 7/1994 |
| WO | WO 97 35795 | | 10/1997 |
| WO | WO 98/18053 | | 4/1998 |

* cited by examiner

*Primary Examiner*—Kathy Matecki
*Assistant Examiner*—Thomas Morrison
(74) *Attorney, Agent, or Firm*—Jones Tullar & Cooper PC

(57) ABSTRACT

Sheets which are overlapped with an offset are supplied to a device for the continuous alignment of sheets by a stream feeder. After alignment of at least the front edge and one lateral edge of each sheet, the sheets can be transferred downstream to a following device.

6 Claims, 4 Drawing Sheets

DEVICE AND A METHOD FOR ALIGNING SHEETS

FIELD OF THE INVENTION

The present invention is directed to a device and to a method for aligning sheets. A plurality of sensors which measure the position of the sheet, are arranged one after the other in the direction of sheet conveyance.

BACKGROUND OF THE INVENTION

A device and a method for aligning sheets is known from EP 0 120 348 A2. The alignment of the front edges of the sheets takes place in a way wherein the sheets, which are arranged in the manner of fish scales, are then fed to the device and are fed to an alignment cylinder of the device at a conveying speed which is greater than the circumferential speed of the alignment cylinder. Front lays are arranged on the circumference of the alignment cylinder, and against which the front edges of the sheets can be placed. Because of the difference in the relative speeds of the sheets and the front lays, the front edge of each of the sheets is braked at least slightly, and the front edge of the sheet is aligned because of this. Following the alignment of the front edge of the sheet, the area of the front edge of the sheet is fixed on a suction strip on the alignment cylinder by the application of a vacuum, so that the sheet is looped around the circumference of the alignment cylinder because of the continued rotational movement of the alignment cylinder. Following the alignment of the front edge of the sheet and prior to transferring the sheet to a downstream-located device, the lateral offset of a lateral edge of the sheet is measured by a measuring device. The suction strip, on which the front edge of the sheet is fixed, is linearly displaced axially in the direction of the axis of rotation of the alignment cylinder as a function of the result of the measurement of the sheet lateral offset, in order to align the lateral edge of the sheet in accordance with a desired alignment. The result of this is that the sheet can be transferred, positioned in the correct position, with respect to its front edge, as well as to a lateral edge, to a subsequent device, such as, for example a sheet-printing press.

A device for sheet guidance in a sheet-fed rotary printing press is known from DE 23 13 150 C3. The sheets are conducted on a feed table, in scaled layers, to the device and then away from the device. The use of suction rollers, on whose entire circumferences recesses are provided, for conveying the sheets lying flat on the feed table is described. Each sheet can be fixed on the circumference of the suction roller by applying a vacuum. In this case, the suction roller is arranged in a recess of the feed table in such a way that the sheets, which lie flat on the feed table and lie tangentially against the circumference of the suction roller, can be driven. It is achieved, by this arrangement, that the respective sheets come into contact with the suction roller only in a line-shaped contact area. The driving forces are frictionally transmitted by the suction roller to each sheet only in the line-shaped contact area. Thus, no looping of the sheets around the suction rollers is required.

A device with a suction drum is known from WO 97/35795 A1. The sheets to be conveyed can be frictionally fixed to the circumference of the suction drum by the application of a vacuum. In this case, the drive mechanism of the suction drum is designed in such a way that the number of revolutions and/or the angle of rotation of the suction drum can be controlled by an independent electrical motor in accordance with pre-selected movement laws.

A sheet-feeding device for printing presses is known from DE-AS 20 46 602. The lateral offset of a lateral edge of a sheet, in relation to a desired orientation, can be detected by a measuring device. For aligning the lateral edge of the sheet, it is possible to displace an alignment cylinder, on whose circumference the sheet is fixed, axially in the direction of its axis of rotation as a function of the measurement result.

A contactless operating device for measuring the position of sheets is known from EP 0 716 287 A2. The lateral edges of the sheets can be measured by an optical system.

DE 42 39 732 A1 shows a device for aligning sheets. The sheets are initially pre-aligned by a belt system, and are thereafter finely aligned by a suction roller.

U.S. Pat. No. 5,078,384 discloses a device for aligning sheets by the use of two individually driven wheels. These driven wheels are controlled by a first sensor signalling the arrival of the sheets, and two sensors detecting the oblique position of the sheet.

EP 0 947 455 A1 describes a device for aligning sheets. Several alignment elements are actuated as a function of sensors which are arranged one behind the other.

WO 98/18053 A1 and U.S. Pat. No. 5,697,609 show devices for aligning sheets. At least three sensors are arranged one behind the other.

SUMMARY OF THE INVENTION

The object of the present invention is directed to providing a device and a method for the alignment of sheets.

In accordance with the present invention, this object is attained by the provision of a device for the alignment of a sheet which has sensors that measure the position of the sheet. At least three such sensors, which each measure the respective position of the sheet, are arranged one behind the other in the sheet conveying direction. The position of the sheet is measured at least three times in succession as the sheet travels in the sheet conveying direction.

The advantages to be obtained by the present invention consist, in particular, in that an edge offset of each sheet can be measured by a total of four sensors prior to, during and subsequent to the alignment of the sheet. The results of the measurements of the different sensors can be used, on the one hand, for controlling the various actuators, in particular the alignment cylinder, by the use of which the alignment of the sheets can be affected. A substantially continuous control and/or documentation of the sheet alignment is assured at the same time. By measuring the sheet alignment during the various phases of the conveyance, in particular, a pre-alignment of the sheets prior to the actual fine alignment at the alignment cylinder becomes possible. Moreover, a final check of the sheet alignment becomes possible prior to the transfer of the sheet to downstream-connected devices, such as, for example a transfer cylinder. In case the permissible position tolerances of the sheet are exceeded, for example, no transfer of that sheet takes place, and the respective sheet is removed.

If a fifth sensor is additionally provided in the device, which fifth sensor is arranged downstream, in the conveying direction, from the third sensor, the edge offset of the front edge of the sheet can still be measured and controlled, in the course of the alignment of the sheet by the alignment cylinder. The sheet alignment can still be corrected, as a function of the result of the measurement by the fifth sensor, by an appropriate actuation movement of the alignment cylinder.

A further advantage of the present invention lies in that a novel way of functioning of the actuator for aligning the edges of the sheet is proposed. In contrast to the known prior art alignment cylinders, on whose circumferences front lays are provided, so that an alignment of the sheet is achieved by the relative speed difference between the front lays and the sheet edge, in accordance with the teaching of the present invention, the sheet can be aligned because at least two cylinder elements are provided at the alignment cylinder. These at least two cylinder elements can come into contact with the sheet and can be adjusted relative to each other in respect to the axis of rotation of the alignment cylinder. In other words, this means that during their contact with the sheet, the cylinder elements move at different absolute speeds. This speed difference is transmitted to the sheet by the contact between the cylinder elements and the sheets. Because of the speed difference of the at least two cylinders, the various sections of the sheets are conveyed over different distances while they rest against the alignment cylinder. It is thus possible to achieve a directed alignment movement of the sheet by an appropriate selection of the relative speed between the cylinder elements.

How the relative speed difference between the cylinder elements of the alignment cylinder is realized is basically unimportant. For example, it would be possible for the at least two cylinder elements to rotate together on a base body at a defined basic speed. For aligning the sheet, the cylinder elements can each be displaced in relation to the base body, and therefore relative to the respectively other cylinder element. It is also possible for the at least two cylinder elements to be driven independently of each other. It is necessary, in this case, for the cylinder elements to be driven synchronously, i.e. at the same drive speed, for conveying the sheets without aligning the edges.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
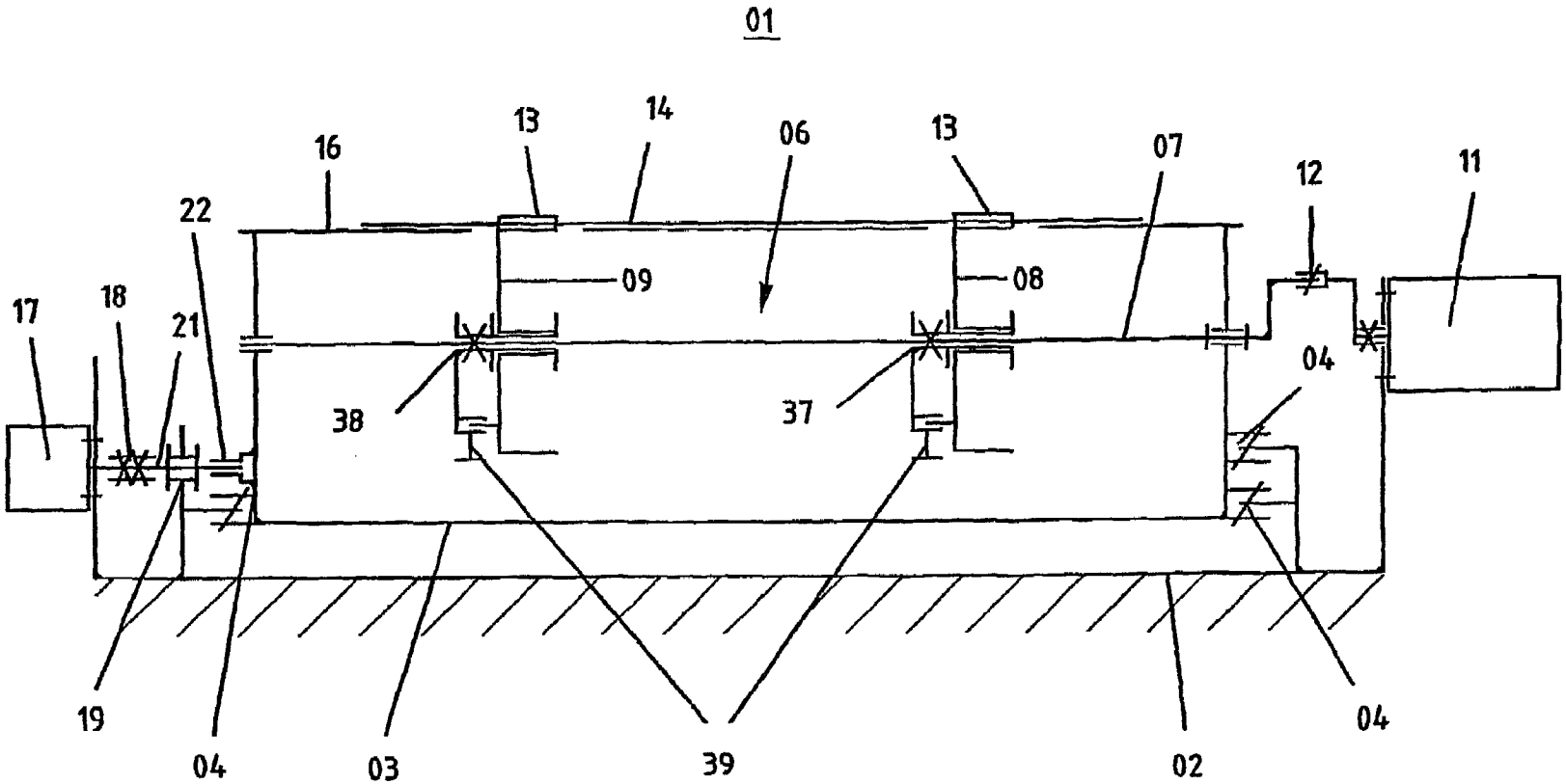
FIG. 1, a schematically represented cross-sectional view of a first preferred embodiment of a device for the continuous alignment of sheets in accordance with the present invention, in FIG. 2, a schematic side elevation view of the device in FIG. 1, in FIG. 3, a schematically represented cross-sectional view of a second preferred embodiment of a device for the continuous alignment of sheets in accordance with the present invention, and in FIG. 4, a schematic side elevation view of the device in FIG. 3.
Figure 2:
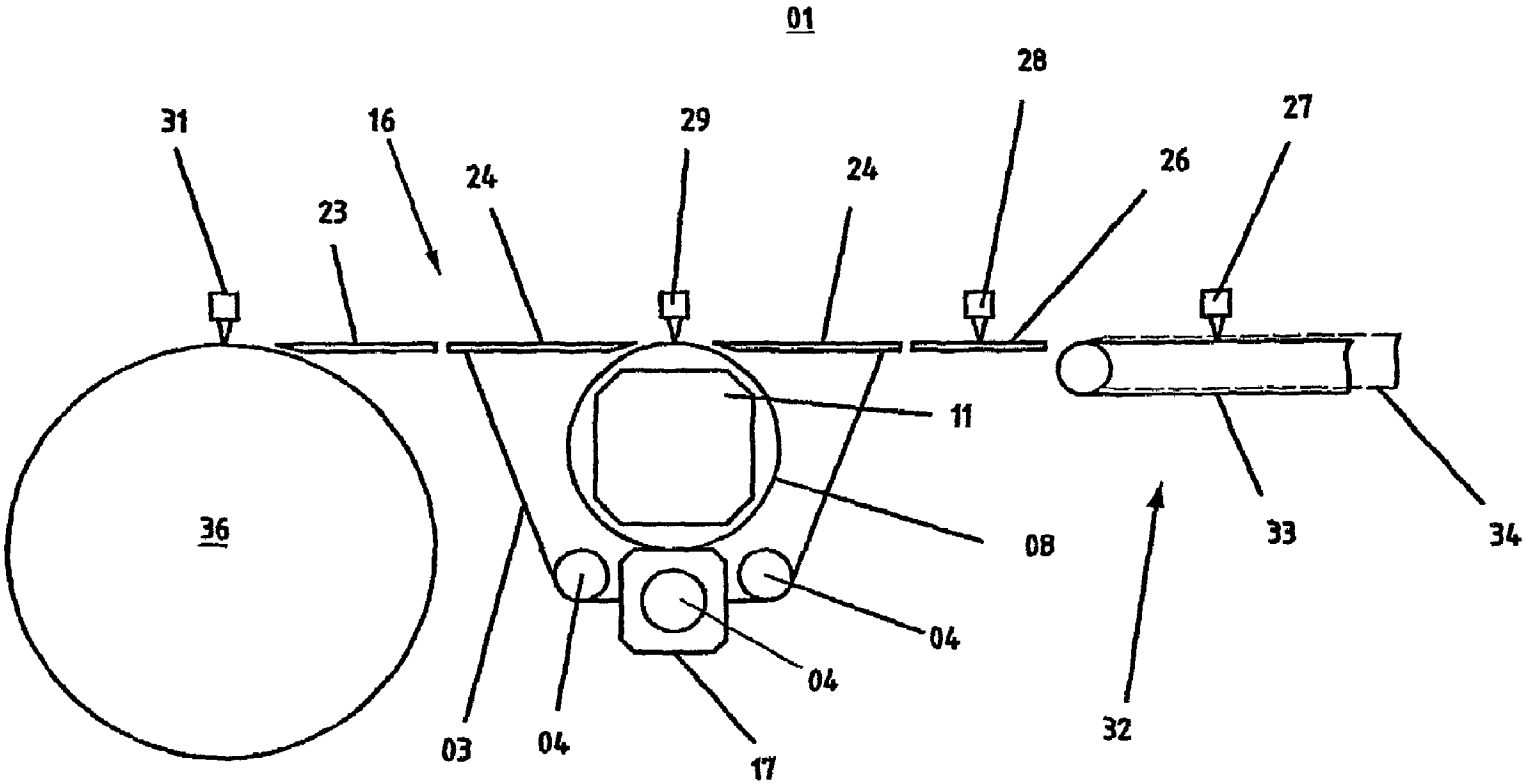

A first preferred embodiment of a device 01 for the continuous alignment of sheets, and in particular for feeding sheets to a sheet-fed rotary printing press, is represented in FIGS. 1 and 2. A first frame element 03, with three linear guides 04, is seated, axially displaceable, on a second frame element 02, which may be embodied in the manner of a rack. An alignment device 06, for example an alignment cylinder 06, which substantially consists of a drive shaft 07 and two suction rollers 08, 09, which are arranged spaced apart from each other on the drive shaft 07, is rotatably seated in the first frame element 03.

An alignment cylinder drive motor 11, which is fixed to a portion of the frame of the second frame element 02, and whose drive movement is transmitted to the drive shaft 07 via a coupling 12, which makes a linear adjustment possible, is used for the rotatory driving of the alignment cylinder 06.

A front lay 13 is fastened on the circumference of each of the suction rollers 08, 09. A sheet 14 being fed, together with other sheets, to the device 01 from a fanning device, which is not specifically represented, comes into contact, at a relative speed difference, with the front lays 13. The front edge of the sheet 14 is thereby aligned at the front lays 13 by being braked. Following the alignment of the front edge of the sheet 14, the sheet 14 is fixed on the suction rollers 08, 09 by the application of a vacuum, for example of 0.2 to 0.6 bar, from a vacuum source in suction chambers, which are not specifically represented. In this case, the sheet 14 rests flat on a feed table 16 that is arranged on the top of the first frame element 03, and the sheet is non-positively connected with the first frame element 03 via the suction rollers 08, 09.

While the suction rollers 08, 09 continue to rotate and thereby convey the sheet 14 on in the conveying direction, the entire first frame element 03, together with the alignment cylinder 06 and the feed table 16, can be axially displaced in the direction of the axis of rotation of the alignment cylinder 06 for the purpose of aligning a lateral edge of the sheet 14. A first frame element drive motor 17 is used for this which, via a coupling 18, drives a ball screw spindle 21 that is seated in a fixed bearing 19. A threaded nut 22 is fastened in the lateral component wall of the first frame element 03 and is in engagement with the ball screw spindle 21. The entire first frame element 03 can be displaced in the linear guides 04 by driving the ball screw spindle 21.

Two hubs 37, 38, which are connected, fixed against relative rotation, with the drive shaft 07, are provided for transmitting torque from the drive shaft 07 to the suction rollers 08, 09. The two hubs 37, 38 can be displaceably fixed on the drive shaft 07 for changing formats. The suction drums 08, 09 can be turned on the hubs 37, 38 for the circumferential adjustment of the front lays 13. Fine adjustment devices 39 are provided between the hubs 37, 38 on the one hand, and the suction rollers 08, 09 on the other, for the fine adjustment of the front lays 13.

The device for the continuous alignment of sheets 01, with the drive motors 11, 17, the suction roller 08 and the front lay 13 arranged on it, the feed table 16, which is constituted from three feed table plates 23, 24, 26, the linear guides 04 and the first frame element 03 are schematically represented in a lateral view in FIG. 2. A total of four sensors 27, 28, 29, 31 are provided and are usable for measuring the edge offset of the sheets 14 to be aligned in the device 01. The edge offset, in particular the edge offset of the front edge of a sheet 14, can be measured by the first sensor 27 prior to entry of a sheet 14 into the device 01. An actuator 32, which is constituted by two conveyor belts extending parallel in respect to each other, is positioned ahead of or before, in the direction of sheet travel on the table 16, of the device 01. Actuator 32 is usable for pre-aligning the sheets 14 prior to the actual alignment of the sheets in the sheet alignment device 01. The conveyor belts 33, 34, which are shown located one behind the other in FIG. 2, can be driven at different speeds as a function of the measurement result from the sensor 27. An alignment movement of the sheets 14 around a vertical axis is generated by the differential speed between the two conveyor belts 33, 34. In principle, it is arbitrary whether a front edge or a lateral edge of the sheets 14 is aligned, or pre-aligned, by operation of the actuator 32. This is a question of the respective intended application. However, in most cases, a front edge of the sheets 14 will be pre-aligned by operation of the actuator 32.

Following the pre-alignment, by operation of the actuator 32, the sheets 14 are conveyed into the sheet alignment device 01, and their front edges come to rest against the front lays 13, which rotate at least slightly slower than the linear speed of the sheets 14. Because of the relative speed difference between the sheets 14 and the front lays 13, the sheet's front edge runs up on the front lays 13 and is aligned in the process. As soon as the front lays 13 have passed the highest point during their rotation, the alignment of the front edge of a sheet 14 is essentially finished. The sheet front end alignment is checked by a measurement by the third sensor 29.

Because of the continued rotational driving of the suction rollers 08, 09, the sheet 14 is conveyed along the table 16 in the sheet alignment device 01 and, following the alignment of the front edge at the front lays 13, the edge offset of a lateral edge of the sheet 14 is surveyed by use of the second sensor 28. As a function of this measured result, the first frame element 03 is linearly displaced by driving the frame displacement drive motor 17 until the difference between the desired alignment of the lateral edge and the measured actual alignment has reached zero. The sheet 14 is conveyed on in the conveying direction by the continued driving of the suction rollers 08, 09 during the alignment of the lateral edge of the sheet 14. In the course of this sheet conveyance, the suction rollers 08, 09 are accelerated by the alignment cylinder drive motor 11 in such a way that upon reaching one of the devices 36 located downstream of the sheet alignment device 01, for example a transfer cylinder 36, the sheet 14 has the same speed as the downstream-located device 36. During the transfer of the sheet 14 from the sheet alignment device 01 to the downstream-located device 36, the alignment of the front edge of the sheet 14 is again surveyed by the fourth sensor 31 in order to check that preset positional tolerances have been maintained.

Figure 3:
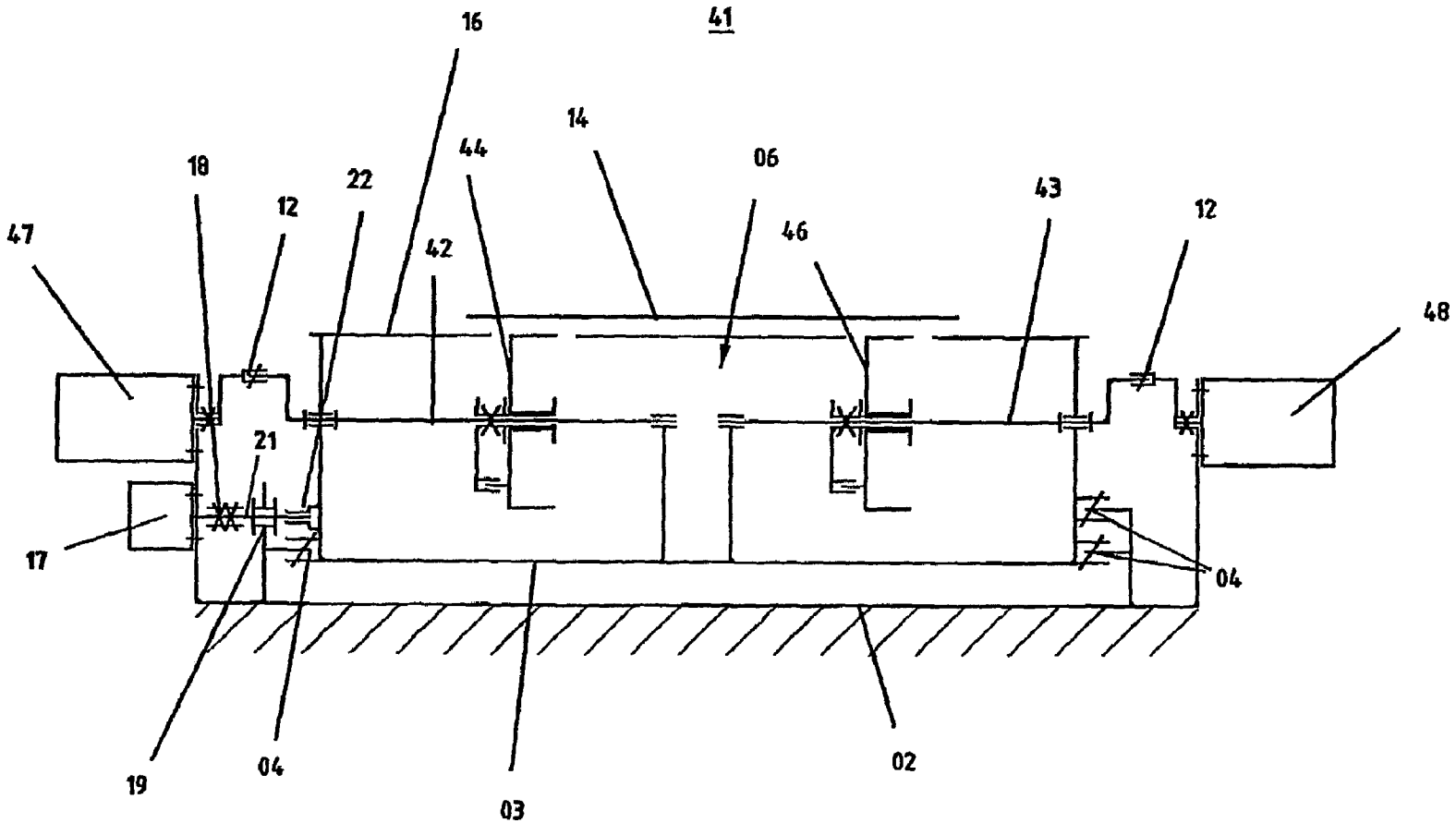
Figure 4:
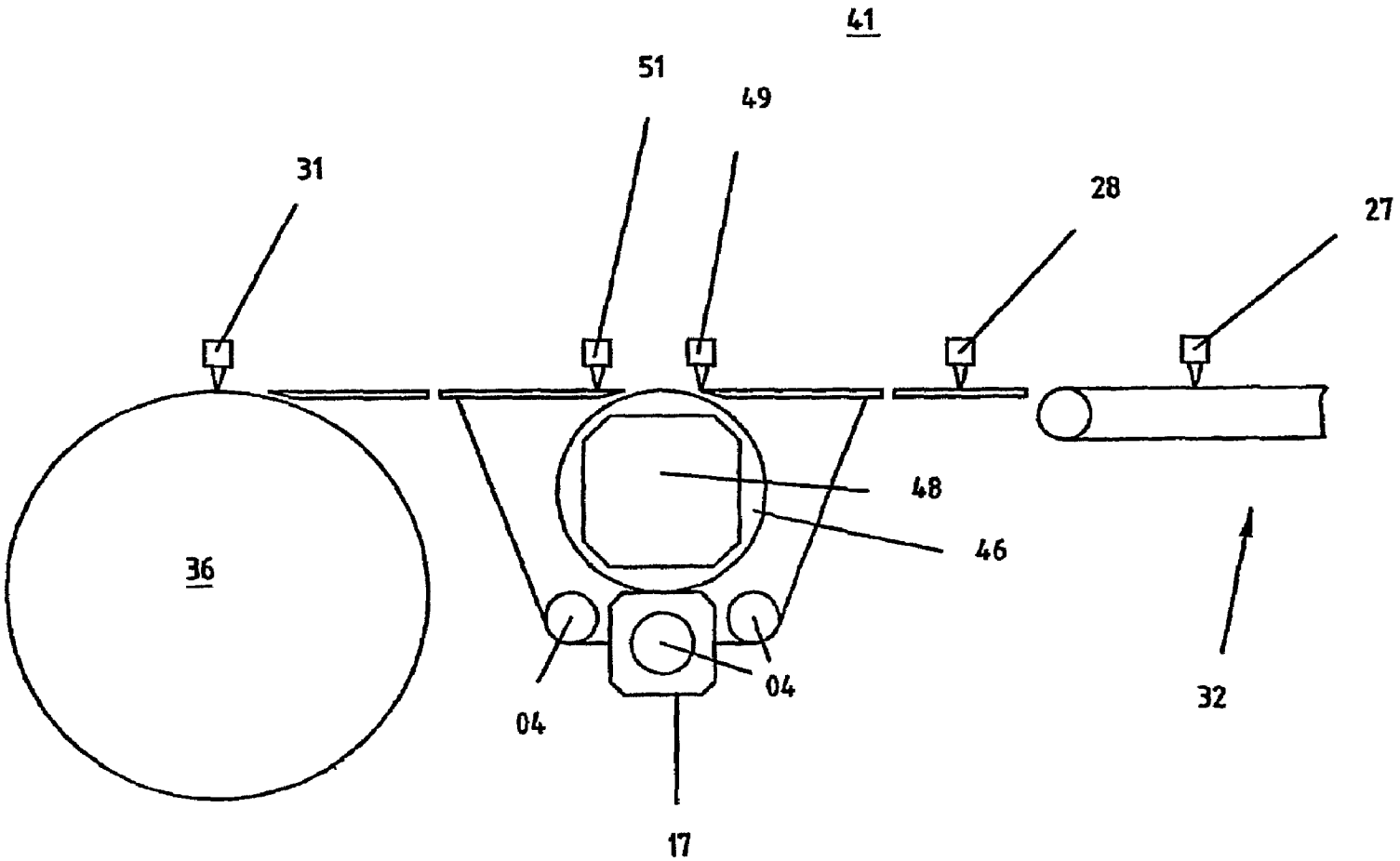

A further preferred embodiment of a device for aligning sheets in accordance with the present invention is represented at 41 in FIGS. 3 and 4, and whose structure essentially corresponds to the structure of the first preferred embodiment of the device 01 of FIG. 1, consisting of a second frame element 02, first frame element 03, linear guides 04, feed table 16 and the transverse displacement arrangement constituted by the drive motor 17, the coupling 18, the fixed bearing 19, the threaded spindle 21 and the threaded nut 22.

The alignment cylinder 06 of the second preferred embodiment of the device 41 has two independent drive trains, which can both drive the sheets 14 independently of each other. Different from the first preferred embodiment of the device 01, with the second embodiment device 41 the alignment cylinder 06 is not driven by a drive shaft 07, but by two drive shafts 42, 43, so that the circumferential speeds of elements 44, 46, for example cylinder elements 44, 46, and in particular suction rollers 44, 46, can be set independently from each other by an appropriate actuation of two suction roller drive motors 47, 48.

For the normal conveyance of the sheets 14 in the conveying direction, the drive motors 47, 48 are actuated synchronously with each other, so that the cylinder elements 44, 46 both rotate at the same circumferential speed. No front lays, as are utilized in the device 01, are provided on the cylinder elements 44, 46 for aligning an edge of the sheet 14, and in particular for aligning the front edge of a sheet. Instead, for aligning the sheet 14, the drive motors 47, 48 are actuated by the control in such a way, that the cylinder elements 44, 46 have a defined speed difference, because of which a rotational movement, around a vertical ordinate axis, is superimposed on the linear conveying movement of the sheets 14 in the conveying direction. A corresponding edge of the sheet 14 can be aligned by the rotational movement of the sheet 14 around the vertical ordinate axis.

For making possible the required linear compensation between the drive motors 47, 48, on the one hand, and the drive shafts 42, 43, on the other hand, which is required for aligning the lateral edge of the sheet 14, appropriately designed couplings 12, which permit a linear compensation, are again used.

FIG. 4 shows the second preferred embodiment of the device 41 for sheet alignment, with the upstream-located actuator 32 and the downstream-located device 36, in a schematically represented lateral or side elevation view. The functioning and operation of the sensors 27, 28, 31 for actuating the actuator 32, or the transverse displacement device, or for the final check of the sheet alignment, corresponds to the functioning of the first embodiment of the device 01, as described and depicted with reference to see FIG. 2. In a manner different from the first device 01, in the second device 41 two sensors 49, 51 are arranged one behind the other in the conveying direction of the sheets 14 above the cylinder elements 44, 46. The edge offset of the front edge of a sheet 14 is measured by the sensor 49 which is situated immediately prior to the transfer of the sheet 14 to the cylinder elements 44, 46. Thereafter, the relative speed between the cylinder elements 44, 46 is selected as a function of the measured result from the sensor 49 in such a way that the desired alignment of the front edge of the sheet 14 is achieved. The alignment of the front edge of the sheet 14 subsequently to the first alignment movement is controlled by the sensor 51 by selection of the appropriate relative speed between the cylinder elements 44, 46, since the sheets 14 still rest against the cylinder elements 44, 46 at the time of the check of the sheet front edge alignment by the sensor 51. If the measurement by the sensor 51 shows a deviation of the alignment of the front edge which cannot be tolerated, the cylinder elements 44, 46 are again driven at appropriate relative speeds in order to correct the alignment of the front edge of the sheet 14.

After correction of the alignment of the front edge of the sheet 14, the alignment of the lateral edges of the sheet 14 are measured by the sensor 28 and they are aligned by driving the motor 17.

While preferred embodiments of a device and a method for aligning sheets, in accordance with the present invention, have been set forth fully and completely hereinabove, it will be apparent to one of skill in the art that a number of changes in, for example, the specific structure of the drive motors, the linear guides, the compensation couplings, and the like could be made without departing from the true spirit and scope of the present invention which is accordingly to be limited only by the appended claims.

What is claimed is:

1. A device for the alignment of a sheet comprising:

a first sheet alignment actuator;

an alignment cylinder, said alignment cylinder being positioned after, in a direction of sheet travel, said first sheet alignment actuator;

a downstream sheet handling device, said downstream sheet handling device being positioned after, in said direction of sheet travel, said alignment cylinder and adapted to receive sheets from said alignment cylinder, and at least first, second and third sensors, each of said at least first, second and third sensors being adapted to measure a position of the sheet, said at least first, second and third sensors being arranged one behind the other in said direction of sheet travel, said first sensor being positioned to measure an edge offset of a front edge of the sheet during entry of the sheet into said first sheet alignment actuator, said first sheet alignment actuator aligning the sheet in response to said first sensor, said second sensor being positioned to measure said edge offset of said front edge of the sheet during, transfer of the sheet from said first sheet alignment actuator to said alignment cylinder, said alignment cylinder aligning said front edge of the sheet in accordance with said second sensor, said third sensor being positioned to measure said edge offset of said front edge of the sheet during transfer of the sheet to said downstream sheet handling device.

2. The device of claim 1 further including a fourth sensor adapted to measure a lateral edge offset of the sheet, and further including a sheet transverse displacement device, said sheet transverse displacement device supporting the sheet during transfer of the sheet from said first sheet alignment actuator to said alignment cylinder, said sheet transverse displacement device including means for moving said sheet transverse displacement device in a direction transverse to said direction of sheet travel to align said lateral edge of the sheet in response to a signal received from said fourth sensor.

3. The device in accordance with claim 1 further including a fourth sensor arranged downstream, in said direction of sheet travel, of said alignment cylinder, said fourth sensor being adapted to measure said edge offset of said front edge of the sheet adhered to said alignment cylinder.

4. A method for aligning sheets including:

providing a sheet alignment actuator;

providing an alignment cylinder;

positioning said alignment cylinder downstream, in a direction of sheet travel from said sheet alignment actuator;

providing at least first, second and third sheet position sensors, adapted for measuring a position of the sheet relative to a sheet conveying direction;

locating said at least first, second and third sheet position sensors one behind the other in said sheet conveying direction;

measuring a front edge offset of a sheet using said first one of said sheet position sensors during entry of the sheet into said sheet alignment actuator;

using said sheet alignment actuator for pre-aligning the sheet in response to a measurement from said first sheet position sensor;

measuring an edge offset of a front edge of the sheet during transferring the sheet to said alignment cylinder using said second one of said sheet position sensors;

using said alignment cylinder and aligning said front edge of the sheet in response to said measuring of said edge offset of said front edge of the sheet by said second sheet position sensor; and measuring said edge offset of said front edge of the sheet during transfer of the sheet to a downstream device using said third one of said at least first, second and third sheet position sensors.

5. The method of claim 4 further including providing a fourth sheet position sensor and using said fourth sheet position sensor for measuring a lateral edge offset of the sheet, and further including providing a transverse displacement device and using said transverse displacement device for aligning said lateral edge in response to said measuring of said lateral edge offset of the sheet by said fourth sheet position sensor.

6. The method of claim 4 further including providing a fourth sheet position sensor, locating said fourth sheet position sensor downstream, in said sheet conveying direction of said second sheet position sensor assigned to said sheet, measuring said edge offset of said front edge of the sheet while the sheet is adhering to said alignment cylinder, and correcting an alignment of said front edge of the sheet by actuating said alignment cylinder in response to said measuring of said edge offset of said front edge of the sheet by said fourth sheet position sensor.

* * * * *